US007746196B2

(12) United States Patent
Svensson et al.

(10) Patent No.: US 7,746,196 B2
(45) Date of Patent: Jun. 29, 2010

(54) ARRANGEMENT RELATING TO ANTENNA COMMUNICATION

(75) Inventors: Bengt Svensson, Molndal (SE); Fredrik Harrysson, Gothenburg (SE)

(73) Assignee: Telefonaktiebolaget L M Ericsson (publ), Stockholm (SE)

( * ) Notice: Subject to any disclaimer, the term of this patent is extended or adjusted under 35 U.S.C. 154(b) by 280 days.

(21) Appl. No.: 11/722,196

(22) PCT Filed: Dec. 22, 2004

(86) PCT No.: PCT/SE2004/001987

§ 371 (c)(1),
(2), (4) Date: Jul. 10, 2007

(87) PCT Pub. No.: WO2006/068550

PCT Pub. Date: Jun. 29, 2006

(65) Prior Publication Data

US 2008/0272856 A1 Nov. 6, 2008

(51) Int. Cl.
*H01P 5/12* (2006.01)
*H01P 3/00* (2006.01)

(52) U.S. Cl. ..... 333/137; 333/239

(58) Field of Classification Search ..... 343/890, 343/891; 333/248, 137, 135, 208, 239
See application file for complete search history.

(56) References Cited

U.S. PATENT DOCUMENTS 2,280,201 A 4/1942 Thompson
2,945,231 A * 7/1960 Scheldorf ..... 343/800
4,599,744 A * 7/1986 Vaughan ..... 455/129
5,017,938 A * 5/1991 Dienes ..... 343/874
6,026,627 A * 2/2000 Moore ..... 52/651.02
6,115,004 A * 9/2000 McGinnis ..... 343/890
7,061,445 B2 * 6/2006 Charlton ..... 343/890
7,205,956 B1 * 4/2007 Sychaleun et al. ..... 343/890

FOREIGN PATENT DOCUMENTS

| | | | |
|---|---|---|---|
| DE | 19529760 | C1 | 11/1996 |
| EP | 018 394 | A2 | 4/1986 |
| GB | 2 117 980 | A | 10/1983 |
| JP | S60-069923 | | 9/1983 |
| JP | H05-302986 | | 4/1992 |
| JP | H11-008503 | | 6/1997 |
| WO | WO 03088407 | A1 | 10/2003 |

* cited by examiner

*Primary Examiner*—Robert Pascal
*Assistant Examiner*—Kimberly E Glenn

(57) ABSTRACT

An arrangement for providing communication between a radio antenna and a radio base station in a cellular communication system. A waveguide is configured to connect the radio base station to the antenna. The waveguide may be connected directly or indirectly to the radio base station and/or the antenna. The waveguide is configured with a number of compartments, each compartment acting as a waveguide for a particular signal. The arrangement is thus able to convey a large number of signals, for example, for sector antennas of dual polarization type and for more than one frequency band.

19 Claims, 10 Drawing Sheets

ARRANGEMENT RELATING TO ANTENNA COMMUNICATION

FIELD OF THE INVENTION

The present invention relates to an arrangement for providing communication between an antenna arrangement and a radio base station at a site. Particularly the invention relates to base station antenna feeding. The invention also relates to a base station and antenna arrangement with an arrangement for providing signal communication therebetween.

STATE OF THE ART

In order to provide for communication between an antenna arrangement and mobile base stations at a site coaxial feeder cables are used today. However, the losses tend to be considerable in such cables, the higher the frequency of the transmitted signals, the higher the losses. In order to reduce the losses, it is exceedingly important to use cables which are as thick as possible for the communication between the active parts of a base station and the antenna arrangement mounted on a mounting structure, for example a mast, at the base station site. The need of thick cables is also particularly of importance since the base stations generally contain all the electronics; today there is practically no electronic at all in the antenna itself.

A common dimension of coaxial cables used today is 1.25 inch cables which have a loss about 0.05 dB/m for 2.2 GHz frequency signals.

The fact that the losses tend to be considerable and that hence even very thick cables are needed, is a serious problem as such, among other since thick cables get bulky, heavy and require a lot of space.

This problem gets even more pronounced due to the fact that, today, the antenna arrangement at a base station site mostly consist of several antennas, and generally each antenna has two polarizations. It is also common to use so called sector antennas, e.g. at so called three sector sites, with three sector antennas, which hence require six (if there are two polarizations) different feeder cables between the base station and the antenna arrangement, particularly all provided along the mast on which the antenna arrangement is mounted. For a six sector site the number of cables will correspondingly be twelve. In addition thereto it is becoming common to use dual or triple frequency band antennas; this means that the number of cables that is required will be even higher, and all these cables somehow have to be bundled together.

This is extremely disadvantageous, since several meters of thick, coaxial cables have to be provided on or close to a mounting structure such as a mast. For the first, it is very unsatisfactory from an aesthetic point of view. Second, it is inconvenient since, due to the fact that thick cables are required, there will be a certain attenuation as well. In addition thereto, installation and mounting will be time consuming and complicated and therefore expensive, and the cables may particularly occupy a large portion of the space of the total mounting structure and hence will predominate visually.

The more complicated the antenna arrangement, i.e. the more sectors, frequency bands etc, the more time consuming and difficult it will be to mount the communication arrangement consisting of a plurality of thick cables between the antenna arrangement and the base station itself, and the higher losses will have to be reckoned with.

SUMMARY OF THE INVENTION

What is needed is therefore an arrangement as initially referred to, which enables communication between a base station and an antenna arrangement which is comparatively slim, and not complex, and which is easy to mount or install. Still further an arrangement is needed which has low losses and which is flexible, i.e. which can be used with different types of antenna arrangements, particularly with antenna arrangements comprising several antennas which may have different polarisations and/or which may be dual or triple frequency band antennas and which may be of sector type. Particularly an arrangement is needed which is aesthetic and which has a low attenuation. Moreover an arrangement is needed which can be used in high frequency systems, i.e. in communication systems using frequencies of more than about 2 GHz. Particularly an arrangement is needed which can be made long and which can be used for a large number of signals, e.g. for sector antennas of dual polarisation type and for more than one frequency band. Still further an arrangement is needed which is easy to fabricate and to transport to the site and which can be produced and handled without high manufacturing high costs. Still further an arrangement is needed which requires little or no maintenance, which easily can be replaced and which is robust and durable.

Therefore an arrangement as initially referred to is provided which comprises a waveguide arrangement connected to a radio base station and to an antenna arrangement. In one embodiment the waveguide arrangement is connected directly to the radio base station and/or directly to the antenna arrangement. This means that it may be connected directly to the radio base station but indirectly to the antenna arrangement or vice versa. Of course it may also be connected directly to the radio base station and to the antenna arrangement. In another or in other implementations the waveguide arrangement is connected indirectly to the radio base station and/or indirectly to the antenna arrangement via intermediate connecting means such as for example jumper cables and connectors disposed at the waveguide arrangement end or ends. Particularly it comprises coax-to-waveguide transitions. In another embodiment the waveguide arrangement comprises waveguide connecting portions which are connected directly to the radio base station and/or directly connected to the antenna arrangement.

Particularly the waveguide arrangement is connected to or associated with an antenna mounting structure, e.g. a mast or similar. Alternative the waveguide arrangement is adapted to be incorporated in or taken up in an antenna arrangement mounting structure. Particularly it is used to provide communication with an antenna arrangement comprising several antennas, for example a multisector antenna with several sector antennas. The waveguide arrangement particularly comprises a plurality of compartments, each acting as a waveguide particularly for a signal to an antenna. Each antenna, for example the multisector antenna, or the antenna if it only comprises one antenna, may have two polarisations, the waveguide arrangement comprising one waveguide compartment for each polarisation and for each antenna, hence for a dual polarisation antenna it comprises two compartments for each sector antenna.

The invention is applicable to most different kinds of antenna arrangements. In one embodiment it provides communication with an antenna arrangement comprising dual band antennas, in another embodiment with a triple band antenna arrangement. To provide communication with a sector antenna, there may be one waveguide compartment for each antenna, particularly one for each frequency band of each antenna, and/or polarization each antenna of the antenna arrangement.

Particularly the waveguide arrangement comprises a longitudinal metal profile structure with a number of waveguides formed by compartments, e.g. one for each antenna, particularly one for each polarisation and one for each band thereof etc. depending on what is applicable.

It may be selected according to the requirements on allowed loss factor etc. In other embodiments there is/are some compartment(s) which is/are multimode compartments, others which are not.

In one embodiment the metal profile structure has a circular cross-section, in other embodiments it has an oval, trapezoidal, triangular or an elliptic cross-section. In still another embodiment it has a rectangular, or particularly a square shaped, cross-section.

The metal profile structure cross-section can be different from that of the respective compartments. The profile structure may e.g. be circular, the compartments rectangular or vice versa. Any combination is possible.

Preferably the metal profile structure is made of some low loss conducting material e.g. aluminium (Al) or a material with similar properties. It may also be made of a material which is coated with a low conducting material e.g. aluminium.

In one embodiment the waveguide arrangement comprises a number of waveguides, each with a rectangular cross-section defined by a waveguide width and a waveguide height. In order to allow for RF signals to propagate, the width of the waveguides has to exceed $\lambda/2$ of the feed signal. The other dimension of a rectangular waveguide compartment, the height, is not restricted to a particular dimension and does actually not affect the propagation of an RF signal, and therefore it can be made low.

In one particular implementation the waveguide arrangement comprises one waveguide which is common for a number of signals to/from different antennas (and/or for different polarisations, frequency bands) and different signals are carried by different waveguide modes in said common waveguide.

In a particular embodiment the waveguide arrangement comprises a limited number of waveguide compartments each of which carrying a number of signals to/from a given number of antennas (polarisations, frequency bands) by means of different modes. The height dimension particularly determines the loss performance of the waveguides. In one embodiment a waveguide width is approximately $0.6\lambda$–$1.0\lambda$, e.g. $0.80\lambda$ which corresponds to 90-150, e.g. 120 mm for a 2 GHz UMTS (Universal Mobile Telecommunications System) signal. Particularly the height of the respective waveguide is about ¼ to ⅛ of the width, particularly around 10-30 mm. Particularly the waveguide dimension, for a 2 GHz signal, is 120×20 mm. The typical loss will then be 0.025 dB/m. If the height of the waveguides is 10 mm, the loss will be about 0.05 dB/m. It should be clear that these figures merely are given for illustrative purposes.

In one embodiment, the antenna structure comprises a single or monolithic structure. In a preferred embodiment the arrangement, or the metal profile structure, comprises a number of sections which are connected to each other such the length of the arrangement substantially corresponds to the sum of the lengths of the individual sections.

In one embodiment with a common multimode waveguide, the individual sections are telescopically connected to each other.

The invention also relates to a base station site with a radio base station and an antenna arrangement with communication means for providing communication between the base station and the antenna arrangement, and an antenna mounting structure, for example a mast or similar. The communication means particularly comprises a waveguide arrangement, which waveguide arrangement is associated with or comprised by, or integrated in, the mounting structure.

Particularly the waveguide arrangement comprises a number of parallel waveguides. Particularly the mounting structure comprises a mast with a number of legs, each leg comprising one or more waveguides of the waveguide arrangement. Particularly the waveguide arrangement comprises a number of compartments, each carrying signals to/from an antenna of the antenna arrangement. Alternatively it comprises a common waveguide supporting propagation of a number of different modes, each carrying one signal to/from one antenna of the antenna arrangement, which may comprise a plurality of antennas, e.g. being a sector antenna, dual polarised antennas, dual or triple band antennas in any combination.

Particularly the invention relates to the use of an arrangement as discussed above in a cellular mobile communication system operating at about 2 GHz or more. Of course, an arrangement according to the inventive concept is applicable for other frequency ranges as well.

BRIEF DESCRIPTION OF THE DRAWINGS

The invention will in the following be more thoroughly described, in a non-limiting way, and with reference to the accompanying drawings in, which.

DETAILED DESCRIPTION OF THE INVENTION

Figure 1:
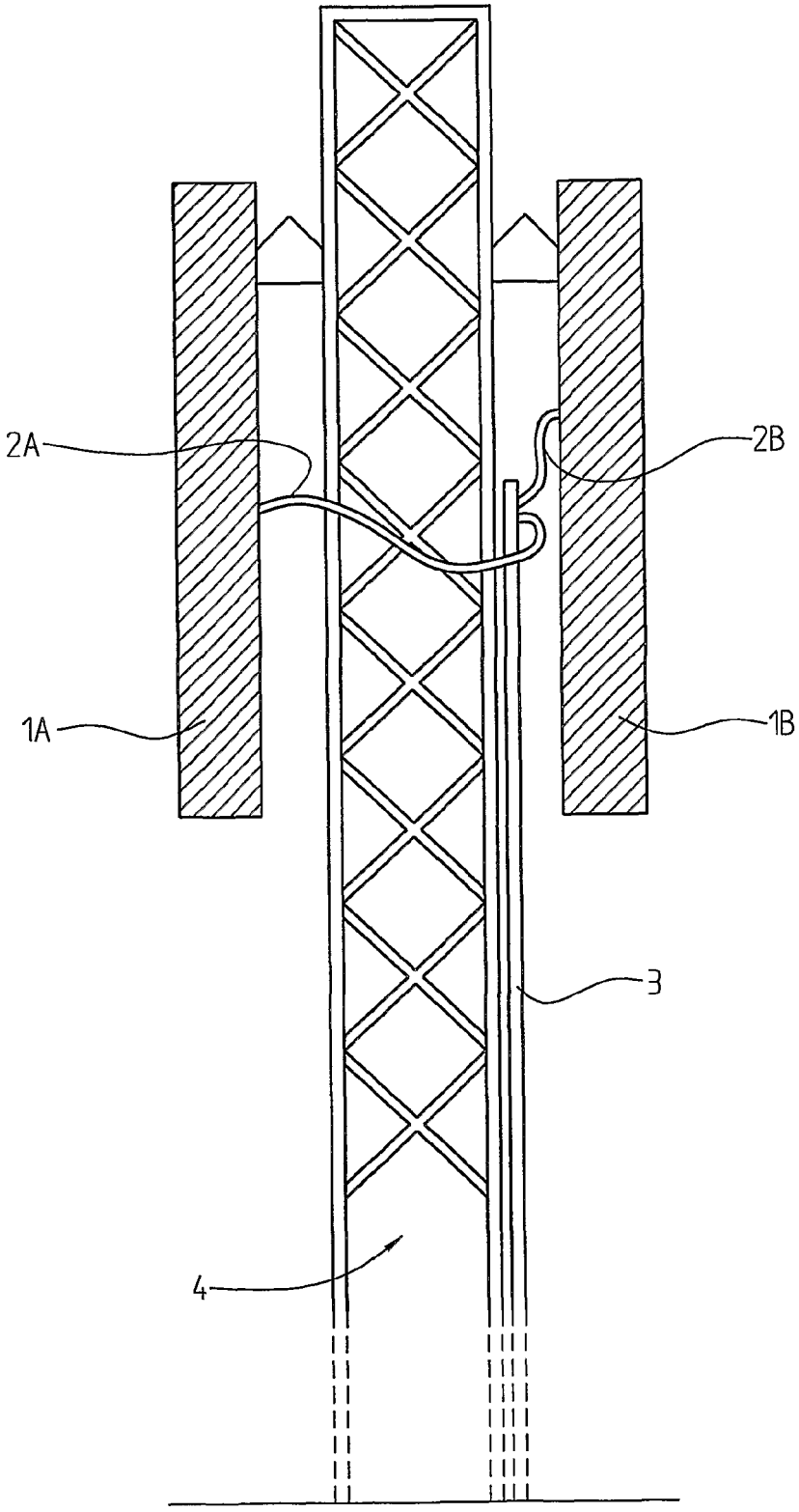
FIG. 1 schematically illustrates an arrangement comprising a waveguide for providing communication between two antennas and a radio base station at a site, FIG. 2 schematically illustrates an arrangement for providing communication between three antennas and a radio base station comprising a waveguide arrangement consisting of three sections and a waveguide-to-coaxial transition at each end, FIG. 3A schematically illustrates a part of a communication arrangement in the form of a waveguide with three compartments connected to one sector antenna of a three sector antenna with a coaxial cable-to-waveguide transition.

FIG. 1 shows an antenna arrangement 1A, 2A mounted on a mounting structure 4, here in the form of a mast, to which the two antennas 1A, 1B are mounted. For communication with the base station (not shown) a waveguide arrangement 3 is associated with the mast structure 4. In this embodiment jumper cables 2A, 2B are provided for connection to the antennas 1A, 1B. It should be clear that the waveguide arrangement 3 also is connected to the base station for example via jumper cables (not shown). Hence, in this embodiment the waveguide arrangement 3 is associated with or connected to the mast structure 4. In an alternative embodiment it may be integrated in the mast structure, or more generally in the mounting structure. In the embodiment of FIG. 1 the waveguide arrangement 3 is illustrated as consisting of one large section. However, preferably, it is generally divided into a plurality of sections of appropriate lengths, which is advantageous for fabrication, transportation and installation purposes. In an alternative embodiment, the waveguide arrangement or the individually waveguides provided therein, might be connected directly to the antenna and/or the base station. In case jumper cables are used, connectors are required at each end of the respective waveguides. It should be clear that the antenna arrangement may comprise more than two antennas or it could be just one antenna. Of course also different kinds of antennas may be used, for example three antennas for a three sector site or six sector antennas for a six sector site etc. Each antenna may have two polarisations and the antenna(s) additionally may be dual or triple band antennas etc.

Figure 4:
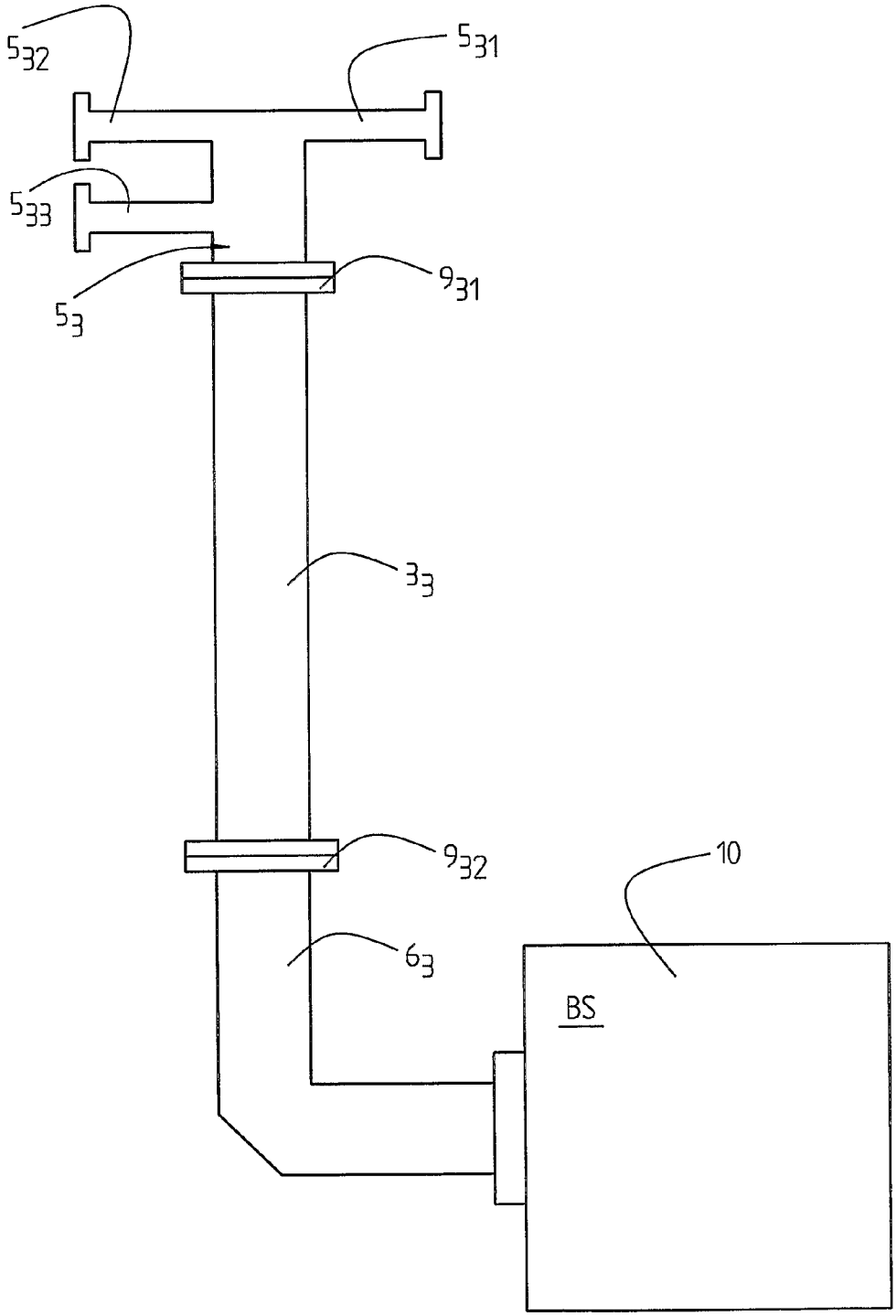

Unless waveguide connecting means are used, cf. FIG. 4, coax-to-waveguide transitions are required both for connection to the antennas and for connection to the base station. FIG. 1 only shows the basic concept of the present invention wherein a waveguide arrangement is used instead of thick cables.

Figure 2:
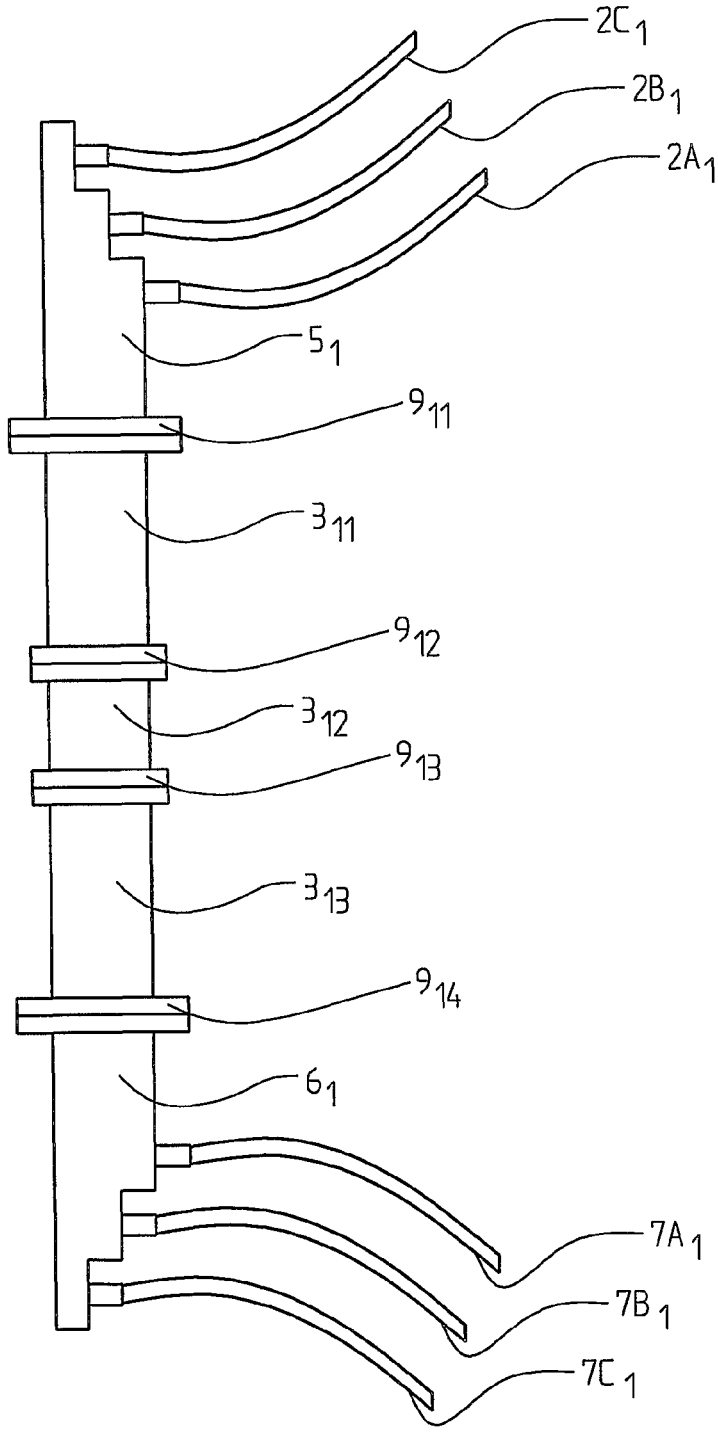

FIG. 2 shows another embodiment in which the waveguide arrangement comprises, here, three waveguide sections $\mathbf{3}_{11}$, $\mathbf{3}_{12}$, $\mathbf{3}_{13}$ which are interconnected by means of flanges $\mathbf{9}_{11}$, $\mathbf{9}_{12}$, $\mathbf{9}_{13}$. The uppermost waveguide section $\mathbf{3}_{11}$ is via a flange $\mathbf{9}_{11}$ connected to a waveguide feed transition $\mathbf{5}_1$ providing transitions to cables $\mathbf{2}A_1$, $\mathbf{2}B_1$, $\mathbf{2}C_1$ connecting to the, here, three antennas (not shown). Similarly a waveguide feed transition $\mathbf{6}_1$ is connected to the lowermost waveguide section $\mathbf{3}_{13}$ via a flange $\mathbf{9}_{14}$ providing transitions to the cables $\mathbf{7}A_1$, $\mathbf{7}A_2$, $\mathbf{7}A_3$ connecting to the base station (not shown). The waveguide arrangement may take any of the forms as will be described more thoroughly below, but also several other embodiments are possible.

Figure 3A:
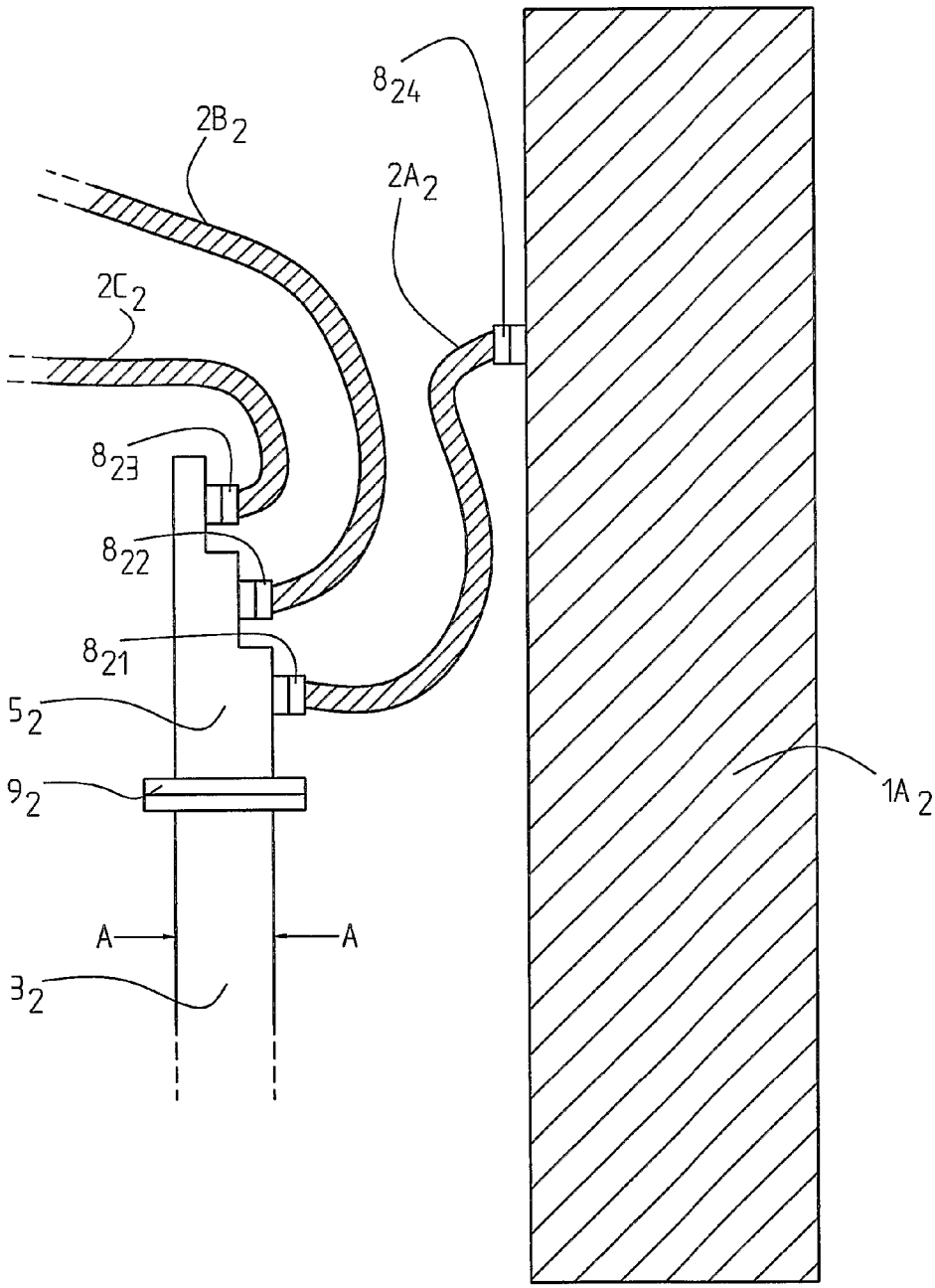
FIG. 3B is a cross-sectional view taken along lines A-A in FIG. 3A of the waveguide arrangement, FIG. 4 schematically illustrates still another embodiment of a waveguide arrangement with waveguide connections provided through direct contact with for example a sector antenna (not shown) and a radio base station.
Figure 3B:
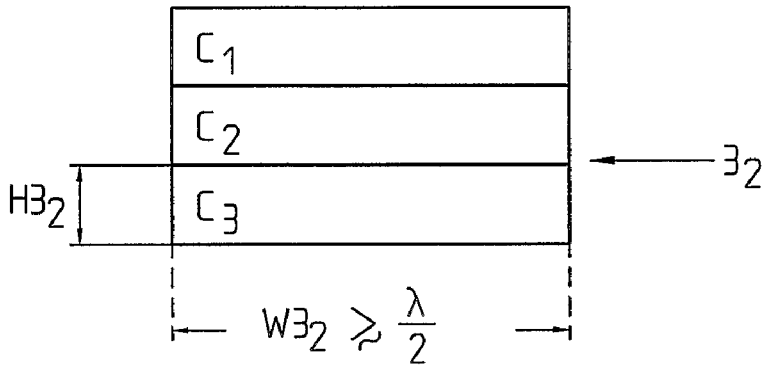

FIG. 3A illustrates a part of a waveguide arrangement $\mathbf{3}_2$ comprising three waveguide compartments (cf. illustration of waveguide arrangement cross-section taken along A-A in FIG. 3B) via a flange $\mathbf{9}_2$ connected to a transition arrangement $\mathbf{5}_2$ with coax to waveguide transitions $\mathbf{8}_{21}$, $\mathbf{8}_{22}$, $\mathbf{8}_{23}$ via cables $\mathbf{2}A_2$, $\mathbf{2}B_2$, $\mathbf{2}C_2$ to three sector antennas of which only the first sector antenna $\mathbf{1}A_2$ is shown.

FIG. 3B shows an example of a cross-sectional view of a waveguide arrangement (as in FIG. 3A) comprising three waveguide compartments $C_1$, $C_2$, $C_3$. The respective waveguides are rectangular waveguides with a width $W\mathbf{3}_2$ approximately $\geqq\lambda/2$. The dimension of the width has to be such in order to enable for RF signals to propagate. The height $H\mathbf{3}_2$ is not restricted by the wavelength and it can be made quite small. Particularly the height determines the loss performance of the waveguide. A typical loss for an air-filled aluminium waveguide with the dimensions 120×20 mm is approximately 0.025 dB/m for a 2 GHz frequency signal. If the height is about 5 mm, the loss is about 0.088 dB/m, if it is about 10 mm, the loss will be about 0.045 dB/m, for a height which is about 15 mm, the loss will be approximately 0.031 dB/m, and for a height of 20 mm it will be about 0.024 dB/m. Thus, the loss is inversely proportional to H.

The losses should be compared with the loss for a 1.25 Inch cable, which is about 0.05 dB/m. At high frequencies (more than 2 GHz) the difference between the losses in an air-filled waveguide and a coaxial cable increases. The waveguide is in principle independent of the frequency whereas for a coaxial cable the loss in dB is proportional to the frequency due to dielectric loss. Dielectrical losses can more easily be avoided in rigid waveguides.

In this embodiment the rectangular waveguides $C_1$, $C_2$, $C_3$ are rectangular and stacked in a common metal profile $\mathbf{3}_2$ comprising the waveguide arrangement. In this particular embodiment the exterior of the profile is rectangular. It may of course also be circular or of any other appropriate shape.

For a 2 GHz UMTS-signal, a typical size could be 0.8λ, which is approximately 120 mm.

Particularly one waveguide or one compartment acts as a waveguide for one feed signal. As will be more thoroughly discussed below, multimode implementations are also possible in which one waveguide may support propagation of more than one mode.

FIG. 4 shows another embodiment of a waveguide arrangement $\mathbf{3}_3$ (which may have any cross-section as will be further described below, for example comprising a number of rectangular compartments etc. but it may also comprise a number of, or a single waveguide, supporting different modes, one for each feed signal). In this embodiment, however, the waveguide arrangement is via a waveguide connection $\mathbf{6}_3$ directly connected to the base station 10 and via a waveguide connection $\mathbf{5}_3$ connected directly to, here, a three sector antenna (not shown) and hence comprising three waveguide connections $\mathbf{5}_{31}$, $\mathbf{5}_{32}$, $\mathbf{5}_{33}$. The waveguide arrangement $\mathbf{3}_3$ is connected via flange $\mathbf{9}_{31}$ to the antenna waveguide connection $\mathbf{5}_3$ and via a flange $\mathbf{9}_{32}$ connected to the base station 10 via the waveguide connection $\mathbf{6}_3$. The flanges $\mathbf{9}_{31}$, $\mathbf{9}_{32}$ can be of any conventional kind. The waveguide connections may alternatively be soldered onto the waveguide arrangement $\mathbf{3}_3$. Even if the waveguide arrangement $\mathbf{3}_3$ in this figure is shown as comprising one section only, it may of course alternatively comprise several sections as for example discussed with reference to FIG. 2. In this embodiment there are no coax-to-waveguide transitions, and hence specifically adapted or special types of antennas/base stations are required.

Figure 5:
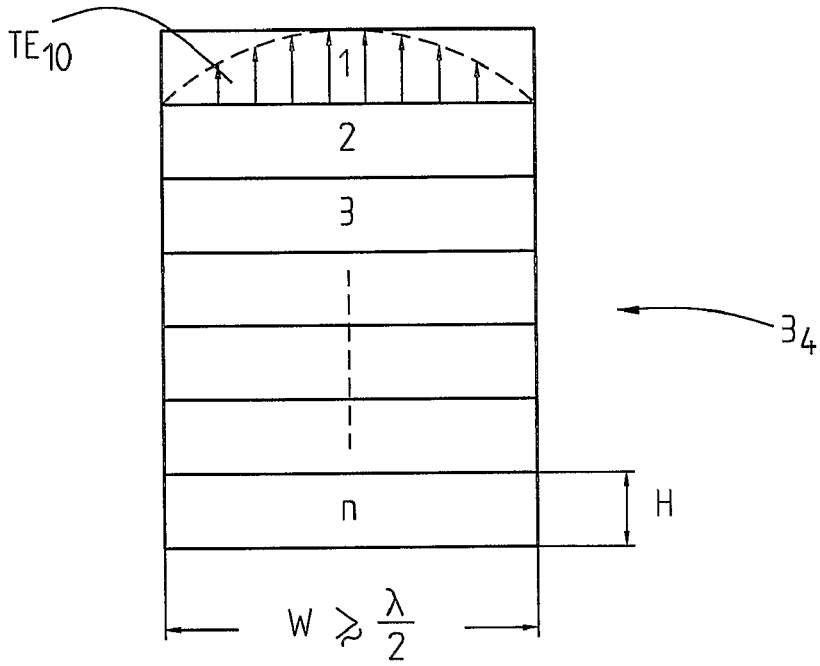
FIG. 5 is a cross-sectional view of a waveguide arrangement comprising n rectangular waveguides.

FIG. 5 is a cross-sectional view of a waveguide arrangement $\mathbf{3}_4$ comprising n rectangular waveguides 1, 2, . . . n with a width W lager than or substantially equal to λ/2 as discussed above. The outer walls are conducting and the interior of the waveguides comprise air or a low-loss dielectric material. The supported fundamental mode is here $TE_{10}$. The waveguides may also support higher order modes, in this case $TE_{20}$, $TE_{30}$ etc, but then they must be larger. Hence, each individual waveguide may support one or more modes, each waveguide handling one feed signal, or if multiple modes or supported, each mode holding one feed signal.

Figure 6:
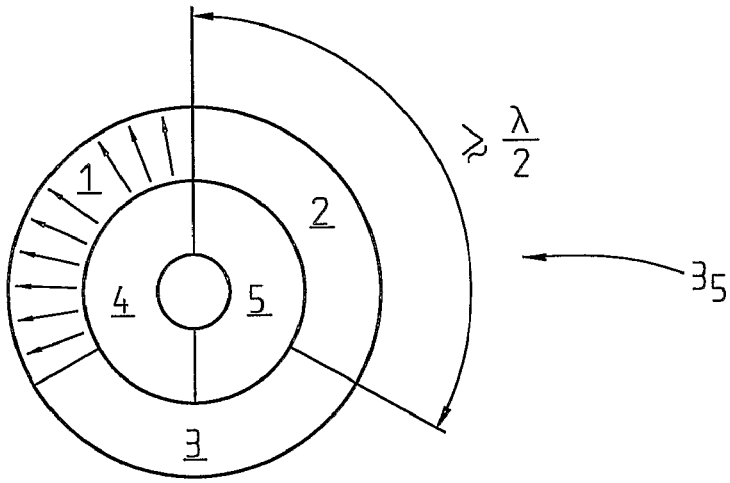
FIG. 6 shows another implementation of rectangular waveguides of a waveguide arrangement with a circular cross-section but with segments forming rectangular waveguides, FIG. 7 schematically illustrates an example of a coaxial waveguide arrangement with n waveguides, FIG. 8A schematically illustrates a waveguide mode fed in a rectangular waveguide.

FIG. 6 shows still another embodiment of a cross-section of a waveguide arrangement $\mathbf{3}_5$ which in principle also acts as an arrangement with a number of rectangular waveguides 1, 2, 3, 4, 5, the length of which (the outer segments 1, 2, 3) should be larger than or substantially equal to $\lambda/2$. The innermost waveguide comprises a circular waveguide for corresponding modes. Also in this case the fundamental supported mode is $TE_{10}$, but the individual waveguides may also support higher order modes such as $TE_{20}$, $TE_{30}$ etc.

Figure 7:
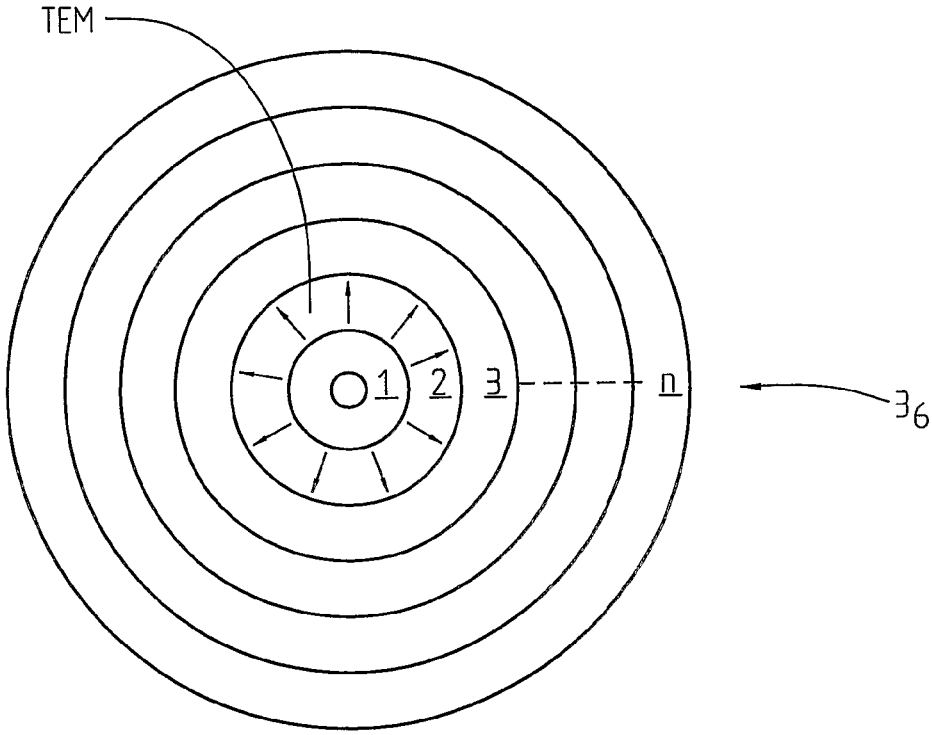

FIG. 7 shows a cross-section of an embodiment of a waveguide arrangement $\mathbf{3}_6$ which comprises a coaxial waveguide in a multilayer implementation, comprising n layers. The fundamental supported mode is here TEM similar to a coaxial cable. The first higher order mode that might be supported is $TE_{11}$ etc. According to different embodiments each waveguide compartment supports one mode, but if it is supported, i.e. if the dimensions of the waveguides are larger (large enough), it is possible for multiple modes to propagate.

Figure 8A:
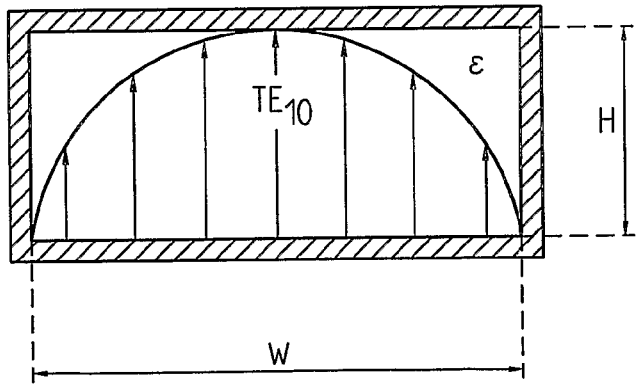
FIG. 8B is a schematical cross-sectional view of a mode fed in a circular waveguide.
FIG. 8C is a schematical cross-section of the fundamental mode fed in a coaxial waveguide, FIG. 9 schematically illustrates the lower part of a waveguide arrangement with connectors for connections, forming coaxial cable-to-waveguide transitions, to a base station, and FIG. 10 schematically illustrates the connection portion (coaxial-to-waveguide transition) for a waveguide arrangement comprising one common waveguide when different waveguide modes allow for propagation of different signals.

FIG. 8A schematically illustrates the fundamental propagating mode for a rectangular waveguide with width W and height H. The walls of the waveguide are conducting and have a thickness exceeding the electrical penetration depth. As referred to above the supported fundamental mode is in such an embodiment $TE_{10}$, i.e. an electrical field transversal with respect to the direction of propagation. If a larger width is used, higher order modes may be supported for feeding signals.

Figure 8B:
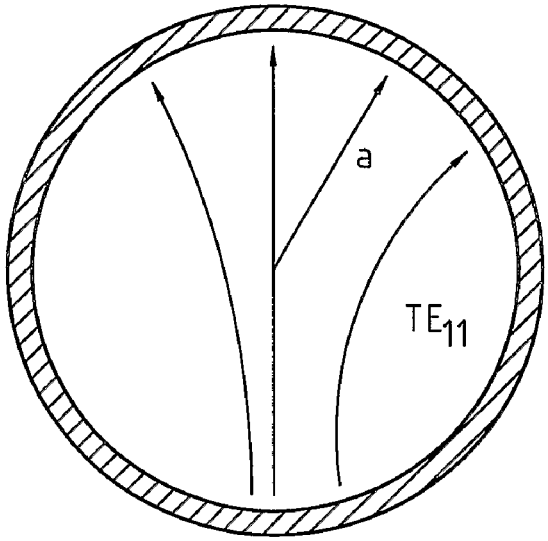

FIG. 8B schematically illustrates the supported waveguide mode of a circular waveguide (CWG) which also has conducting walls etc., c.f. FIG. 8A. The fundamental propagating mode is here $TE_{11}$. With a larger cross-section, it may also support one or more higher order modes, for example $TM_{01}$.

Figure 8C:
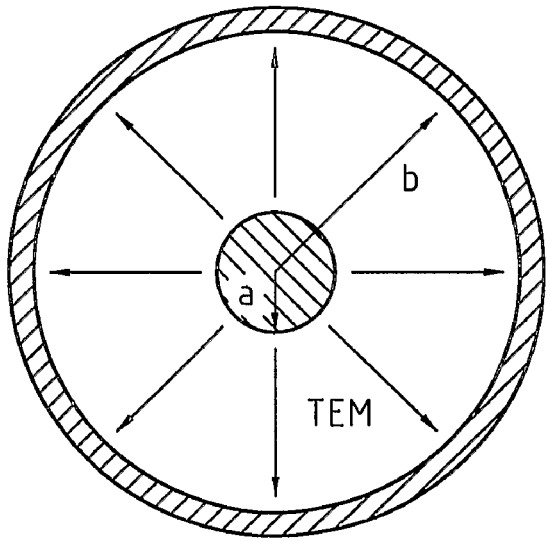

FIG. 8C is a cross-sectional view of a coaxial waveguide wherein b here corresponds to the radius of the outer conductor and a is the radius of the inner conductor. Higher order modes may be supported if a larger radius is selected, e.g. $TE_{11}$ etc. It should be clear that these figures merely show some examples on waveguide cross-sections.

Figure 9:
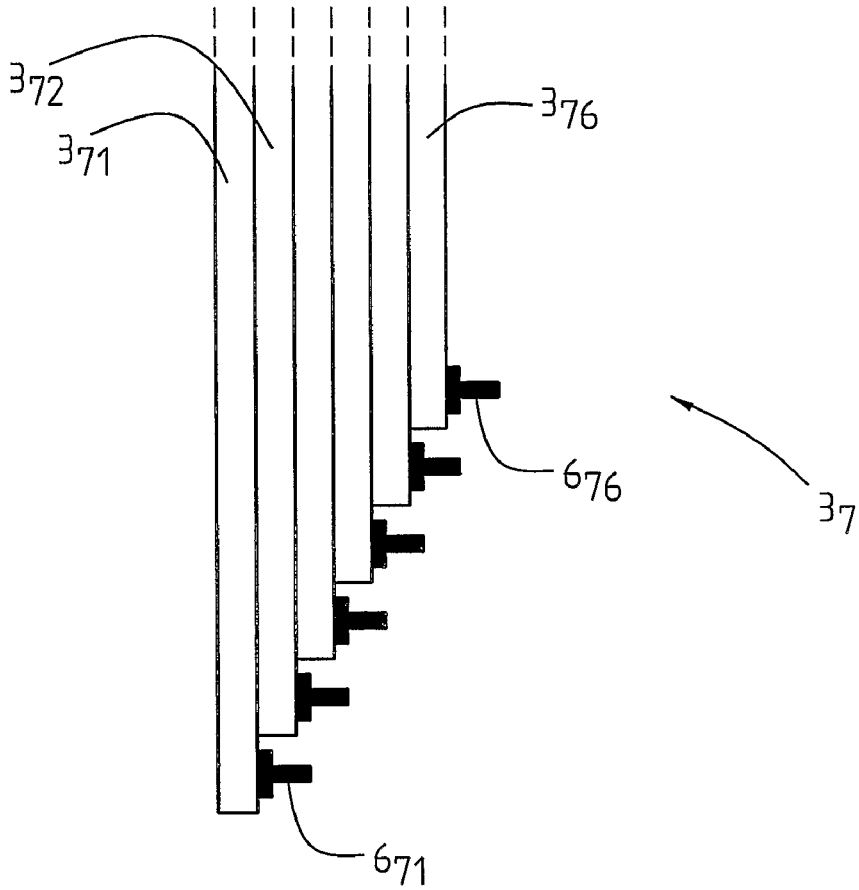

FIG. 9 is a very simplified view of a waveguide arrangement $\mathbf{3}_6$ comprising a number of waveguide compartments $\mathbf{3}_{71}, \ldots, \mathbf{3}_{76}$, one for each feed signal to an antenna arrangement/a base station, each waveguide comprising a connector $\mathbf{6}_{71}, \ldots, \mathbf{6}_{76}$ for connection to the base station (the respective antenna) as discussed earlier in the application.

Figure 10:
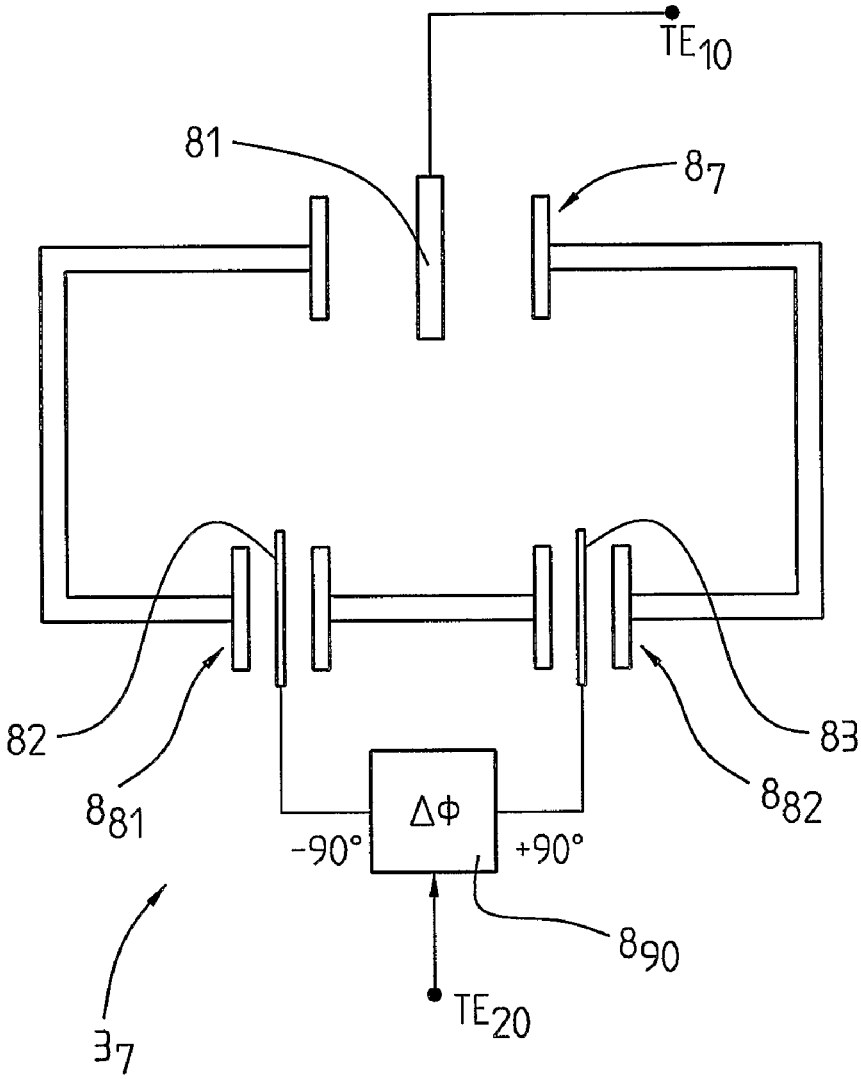

FIG. 10 shows one example of a coaxial-waveguide transition for a multimode implementation according to the invention. It shows a cross-section of a rectangular waveguide $\mathbf{3}_7$. $TE_{10}$ feeding is provided by means of the central metal conductor 81 of a coaxial cable with outer conductors $\mathbf{8}_7$. $TE_{20}$ feeding is provided by means of a phase shifted $\mathbf{8}_{90}$ which provides two signals phase shifted +/−90° and which are fed via the central conductors 82, 83 of two coaxial-waveguide transitions $\mathbf{8}_{81}$, $\mathbf{8}_{82}$. $TE_{10}$ is fed symmetrically and $TE_{20}$ is fed differentially.

An alternative embodiment (not shown) is using a 4-port sum/delta-divider where the $TE_{10}$ mode is fed to the sum-port resulting in two identical (symmetric feeding) signals fed to 82 and 83, and where the $TE_{20}$ mode is fed to the delta-port resulting in two equal amplitude but 180° phase shifted (differential feeding) signals simultaneously fed to 82 and 83. The divider is reciprocal so that the principle applies for transmission in both directions.

It should be clear that different kinds of waveguides can be used. It is for example also possible to use ridge waveguides.

It is an advantage of the invention that the communication, for example all feed signals, can be collected in a slim waveguide as compared coaxial feeder cables which are thick and have large losses. Still further it is an advantages that the arrangement for providing communication between a base station and an antenna arrangement can be made more aesthetic and less optically dominating, than a large number of thick coaxial feeder cables. It is particularly advantageous that the arrangement can be integrated in a mounting structure, for example a mast, or in the legs of a mast structure. It is also advantageous that, through the use of waveguides for signal transmission, the losses will be very low. The losses are, even for low profile waveguides, lower than for thick coaxial cables. It is also an advantage that a waveguide arrangement, particularly one comprising a number of sections, can be easily fabricated and installed at a low cost, and it is easy to transport and resistant to damages. It is also advantageous that such a waveguide arrangement is particularly easy and cheap to fabricate and it e.g. comprises conventional extruded aluminium profiles or a material coated with aluminium.

Moreover for example for 3G (3GPP, Third Generation Partnership Project) implementations frequencies which are high are used, which means that the losses get high if cables are used, it is clearly advantageous to a use waveguide arrangement instead of very thick coaxial cables.

It is also advantageous that the waveguide arrangement may fabricated in sections which simply are mounted to each other by means of flanges or similar since the mounting structure is a mast, which may be very high, even up to 20-30 meter or more.

It should be clear that the invention is not limited to the specifically illustrated embodiments but that it can be varied in a number of ways without departing from the scope of the appended claims.

Particularly may each waveguide in a waveguide arrangement support propagation or transmission of signals by one or more modes and the profile structure can be made with any cross-sectional shape, square-shaped, rectangular, circular, elliptic, oval etc. It should also be clear that the higher the frequency of the propagating signals is, the higher is the gain of using a waveguide arrangement.

The invention claimed is:

1. A waveguide arrangement for providing communication between an antenna and a transceiver in a radio base station, said waveguide arrangement comprising:

a waveguide: and means for connecting the waveguide to the radio base station and to the antenna;

wherein the waveguide includes a plurality of waveguide compartments extending along a length of the waveguide, each of the waveguide compartments acting as a waveguide for a particular signal;

wherein the waveguide arrangement supports communication of a plurality of signals between the radio base station and the antenna; and wherein at least one of the waveguide compartments is a multimode compartment, wherein each mode carries one of the plurality of signals.

2. The waveguide arrangement as recited in claim 1, wherein the waveguide arrangement is implemented within an antenna mounting structure.

3. The waveguide arrangement as recited in claim 1, wherein the base station includes a plurality of antennas and the waveguide includes one multi-mode waveguide common for a number of the signals to/from different antennas, and/or a number of the signals having different polarizations, and/or a number of the signals in different frequency bands, wherein the signals of differing antennas, polarizations, and/or frequency bands are carried by different waveguide modes.

4. The waveguide arrangement as recited in claim 1, wherein the plurality of waveguide compartments includes a limited number of waveguide compartments, each of which carries a number of the signals by different modes.

5. The waveguide arrangement as recited in claim 1, wherein the waveguide arrangement includes a longitudinal metal profile structure comprising the plurality of waveguide compartments.

6. The waveguide arrangement as recited in claim 5, wherein the metal profile structure has a cross-sectional configuration selected from a group consisting of rectangular, circular, elliptic, oval, trapezoidal, and triangular.

7. The waveguide arrangement as recited in claim 6, wherein the metal profile structure is constructed of a low-loss conducting material or a material which is coated with a low-loss conducting material.

8. The waveguide arrangement as recited in claim 6, wherein the waveguide includes a number of circularly disposed waveguide segments.

9. The waveguide arrangement as recited in claim 6, wherein each of the waveguide compartments has a rectangular cross-section defined by a waveguide width and a waveguide height.

10. The waveguide arrangement as recited in claim 9, wherein the waveguide width (W) is larger than one-half of a wavelength ($\lambda$) of the signal carried by the waveguide.

11. The waveguide arrangement as recited in claim 10, wherein the waveguide width is in a range of 0.6 $\lambda$ to 1.0 $\lambda$ of the signal carried by the waveguide.

12. The waveguide arrangement as recited in claim 11, wherein the waveguide height is approximately ¼ to ⅛ of the waveguide width.

13. The waveguide arrangement as recited in claim 1, wherein the waveguide is a coaxial waveguide comprising the plurality of waveguide compartments.

14. The waveguide arrangement as recited in claim 1, wherein the waveguide arrangement comprises one single, monolithic structure.

15. The waveguide arrangement as recited in claim 1, wherein the waveguide arrangement comprises a number of longitudinal sections connected to each other, wherein each of the longitudinal sections has a width and a length, and a length of the arrangement substantially corresponds to a sum of the lengths of the longitudinal sections.

16. A waveguide arrangement for providing communication between an antenna and a transceiver in a radio base station, said waveguide arrangement comprising:

a waveguide; and means for connecting the waveguide to the radio base station and to the antenna, wherein the means for connecting the waveguide to the radio base station and to the antenna includes one of:

means for connecting the waveguide directly to the radio base station and/or to the antenna; and means for indirectly connecting the waveguide to the radio base station and/or to the antenna via intermediate connecting means;

wherein the waveguide includes a plurality of waveguide compartments extending along a length of the waveguide, each of the waveguide compartments acting as a waveguide for a particular signal; and wherein the waveguide arrangement supports communication of a plurality of signals between the radio base station and the antenna.

17. A waveguide arrangement for providing communication between an antenna and a transceiver in a radio base station, said waveguide arrangement comprising:

a waveguide: and means for connecting the waveguide to the radio base station and to the antenna:

wherein the waveguide includes a plurality of waveguide compartments extending along a length of the waveguide, each of the waveguide compartments acting as a waveguide for a particular signal;

wherein the waveguide arrangement supports communication of a plurality of signals between the radio base station and the antenna; and wherein the antenna is a dual polarized antenna, and the plurality of waveguide compartments includes a waveguide compartment for each polarization of the dual polarized antenna.

18. A waveguide arrangement for providing communication between an antenna and a transceiver in a radio base station, said waveguide arrangement comprising:

a waveguide; and means for connecting the waveguide to the radio base station and to the antenna;

wherein the waveguide includes a plurality of waveguide compartments extending along a length of the waveguide, each of the waveguide compartments acting as a waveguide for a particular signal;

wherein the waveguide arrangement supports communication of a plurality of signals between the radio base station and the antenna; and wherein the antenna is a dual or triple band antenna, and the plurality of waveguide compartments includes a waveguide compartment for each of the bands of the antenna.

19. A base station, comprising:

a transceiver for generating communication signals;

an antenna; and a waveguide arrangement supporting communication of a plurality of signals between the transceiver and the antenna;

wherein the waveguide arrangement includes a plurality of waveguide compartments extending along a length of the waveguide arrangement, each of the waveguide compartments acting as a waveguide for a particular signal of the plurality of signals;

wherein at least one of the waveguide compartments is a multimode compartment, wherein each mode carries one of the signals.

* * * * *

UNITED STATES PATENT AND TRADEMARK OFFICE

CERTIFICATE OF CORRECTION

PATENT NO. : 7,746,196 B2
APPLICATION NO. : 11/722196
DATED : June 29, 2010
INVENTOR(S) : Svensson et al.

It is certified that error appears in the above-identified patent and that said Letters Patent is hereby corrected as shown below:

In Column 8, Line 47, in Claim 1, delete "waveguide:" and insert -- waveguide; --, therefor.

In Column 10, Line 14, in Claim 17, delete "waveguide:" and insert -- waveguide; --, therefor.

In Column 10, Line 16, in Claim 17, delete "antenna:" and insert -- antenna; --, therefor.

Signed and Sealed this

Nineteenth Day of October, 2010

David J. Kappos

David J. Kappos
*Director of the United States Patent and Trademark Office*